US005579846A

United States Patent [19]

Meyer et al.

[11] Patent Number: 5,579,846

[45] Date of Patent: Dec. 3, 1996

[54] EXTENDED COVERAGE CEILING SPRINKLERS AND SYSTEMS

[75] Inventors: George G. Meyer; Stephen J. Meyer, both of Malvern; George S. Polan, Harleysville, all of Pa.

[73] Assignee: Central Sprinkler Corporation, Lansdale, Pa.

[21] Appl. No.: 342,465

[22] Filed: Nov. 21, 1994

Related U.S. Application Data

[63] Continuation of Ser. No. 875,928, Apr. 29, 1992, Pat. No. 5,366,022, which is a continuation-in-part of Ser. No. 769, 917, Sep. 30, 1991, abandoned.

[51] Int. Cl.[6] ..... A62C 37/08

[52] U.S. Cl. ..... 169/37; 169/16

[58] Field of Search ..... 169/37, 38, 16, 169/17; 239/498

[56] References Cited

U.S. PATENT DOCUMENTS

| | | | |
|---|---|---|---|
| D. 251,128 | 2/1979 | Groos et al. | D23/6 |
| D. 348,719 | 7/1994 | Dolan | D23/214 |
| 2,279,374 | 4/1942 | Jung | 239/498 |
| 2,550,456 | 4/1951 | De Flon | 239/498 |
| 2,697,008 | 12/1954 | Rowley | 299/121 |
| 2,724,614 | 11/1955 | Rider | 299/121 |
| 3,682,251 | 8/1971 | Livingston | 169/37 |
| 3,722,596 | 8/1973 | Livingston . | |
| 3,802,512 | 4/1974 | Todtenkopf | 169/37 |
| 3,874,455 | 4/1975 | Klesow | 169/19 |
| 3,888,313 | 6/1975 | Freeman | 169/37 X |
| 3,904,126 | 9/1975 | Allard . | |
| 4,066,129 | 1/1978 | Anderson | 169/37 |
| 4,099,675 | 7/1978 | Wohler et al. | 169/37 X |
| 4,136,740 | 1/1979 | Groos et al. | 169/39 |
| 4,279,309 | 7/1981 | Fischer et al. | 169/37 |
| 4,405,018 | 9/1983 | Fischer | 169/37 |
| 4,569,289 | 2/1986 | Gielow et al. | 105/2 R |

(List continued on next page.)

FOREIGN PATENT DOCUMENTS

| | | | |
|---|---|---|---|
| 1252143 | 12/1960 | France | 169/37 |
| 6400053 | 7/1964 | Netherlands | 169/37 |
| 765125 | 1/1957 | United Kingdom . | |
| 2177912 | 2/1987 | United Kingdom | 169/37 |
| 2206043 | 12/1988 | United Kingdom | 169/37 |

OTHER PUBLICATIONS

"Automatic" Sprinkler Corporation of America product sheet entitled "Automatic" ESFR Glass Bulb Sprinkler J 5.3, Feb. 1988, and J 5.4, 1988 (2pp. total).

(List continued on next page.)

*Primary Examiner*—Gary C. Hoge
*Attorney, Agent, or Firm*—Panitch Schwarze Jacobs & Nadel, P.C.

[57] ABSTRACT

Ceiling sprinklers and sprinkler systems provide extended areas of coverage through a combination of extra large and super large orifices and deflectors which extend radial distributions with acceptable uniform average and absolute distribution densities all around and beneath the sprinklers. Described deflectors are circular and substantially flat, being essentially flat in pendent style and slightly fructoconical in upright style. Slots of alternating length are provided extending inwardly towards the center of the deflector from the circular perimeter to within no more than one-half inch and preferably no more than 0.6 of an inch from the center of the deflector. The upright sprinkler deflector includes central circular planar areas at least one inch and preferably at least 1.2 inch in diameter while the outer annular peripheral portion of such deflectors are coned back towards their supporting tubular bodies at an included cone angle of about one hundred forty degrees or more. Sprinkler systems of the present invention can be installed with closest adjoining pairs of sprinklers and branch lines spaced more than fifteen feet apart when the sprinklers are located within at least seven feet six inches and as close as only three feet to the protected area.

24 Claims, 3 Drawing Sheets

U.S. PATENT DOCUMENTS

| | | | |
|---|---|---|---|
| 4,580,729 | 4/1986 | Pounder | 239/524 |
| 4,624,414 | 11/1986 | Ferrazza | 239/467 |
| 4,699,217 | 10/1987 | McLennan et al. | 169/37 |
| 4,791,993 | 12/1988 | Curran | 169/37 X |
| 4,800,961 | 1/1989 | Klein . | |
| 4,880,063 | 11/1989 | Leininger et al. | 169/37 |
| 4,901,799 | 2/1990 | Pepi et al. | 169/37 X |
| 4,923,013 | 5/1990 | De Gennaro | 169/37 X |
| 4,930,578 | 6/1990 | Barnett et al. | 169/39 |
| 4,964,574 | 10/1990 | Daigle . | |
| 5,020,601 | 6/1991 | Retzloff et al. | 169/37 |

OTHER PUBLICATIONS

Sheet entitled "Grinnell Jumbo Sprinkler Issue A", Grinnell Corp., Feb. 1969, (1 p.).

Drawing entitled "Grinnell Large Capacity Protectospray Nozzle Type D–3 Frame", "B–1800", Grinnell Corporation, Jun. 1981 (1 p.).

Drawing entitled "Grinnell Large Capacity Protectospray Nozzle Type D–3 Assembly", "B–1801", Grinnell Corporation, Jun. 1981 (1 p.).

Drawing entitled "Grinnell Protectospray Nozzle Type D–3, D–4 Splitter" and "A 7023", Grinnell Corporation, Dec. 1966 (1 p.).

Drawing entitled "Grinnell Large Capacity Protectospray Nozzle Type D–3 Deflector" and "A–3780", Grinnell Corporation, Jan. 1964 (1 p.).

Collection of figures, Figure 1–Figure 7 entitled "Types D–3 and D–4a Protectospray Nozzles", and Figure 8–Figure 9 entitled "Type D3 Large Capacity Protectospray Nozzles" Figure 10–Figure 13 entitled "Type EA–1 Protectospray Nozzles", Grinnell Corporation, Sep. 1985 (13 pp.).

Bulletin No. 211 entitled "Sprinklers, Nozzles and Accessories/Section 4 Duraspeed® Sprinkler–Rack Storage–Q–17", Grinnell Corporation, Jan. 1975 (2 pp.).Sheet entitled "Grinnell Quartzoid Sprinkler, Issue D Large Orifice–¾" N.P.T. Connection", Grinnell Corporation, Sep. 1971 (1 p.).

Sheets entitled "Large Orifice Upright & Pendent Sprinklers Issue D Bulb Type, 17/32" Orifice–½" N.P.T. Connection", Grinnell Corporation, Aug. 1978, (2 pp.).

Bulletin No. 305 entitled "Sprinklers Nozzles And Accessories/Section 4 Quartzoid Pull Type Sprinkler Style: Pendent, Upright, Old Style", Grinnell Fire Protection Systems Company, Inc., Jul. 1974, (2 pp.).

Sheet entitled "Grinnell Quartzoid Sprinkler", Issue D Pull Type, Grinnell Corporation, Sep. 1971 (1 p.).

Sheet entitled "Grinnell Quartzoid Sprinkler Issue–D", Grinnell Company, Inc., Nov. 1959, (1 p.).

Sheet entitled "Grinnell Q16 Sprinklers Engineering Data", Grinnell Corporation, Sep. 1971 (1 p.).

Viking Technical Data sheet entitled "High Challenge™ Upright Sprinkler", The Viking Corp., Mar. 1977 (1 p.).

Equipment Application Data sheets entitled "High Challenge® Sprinklers/Application Report: Digital Equipment Corporation", the Viking Corp., May, 1986 (4 pp.).

N. J. Thompson, *Fire Behavior and Sprinklers*, Chapter 6 "Automatic Sprinkler Protection", National Fire Protection Association, 1964, Cover, Foreward, Table of Contents and pp. 72–91.

Newsletter for Fire Protection Engineers and Industry, No. 11, Jul. 1965, Orinda, California (8 pp.).

Technical Report entitled "Optimization of Sprinkler Protection for United States Postal Service III. Protection of Plastic Letter Trays", Factory Mutual Research Corporation, Oct. 1971 (39 pp.).

Technical Report No. AFWL–TR–72–entitled "Fire Protection Study USAF Mobility Program Structures and Large Air Force Warehouses Phase 2", Factory Mutual Research Corporation, Nov. 1972 (65 pp. with cover and introductory pages).

Technical Report entitled "Protection of Idle Polyethylene Plastic Palettes with Viking Prototype Sprinklers (0.64 in. Orifice)", Factory Mutual Research Corporation, Jan. 1974, (29 pp. with cover and introductory pages).

Technical Report entitled "Optimization of Sprinkler Protection For United States Postal Facilities/IV Protection of Plastic Letter Trays With 0.64–IN. Retrofit Sprinklers", Factory Mutual Research, Jul. 1974 (30 pp. with cover and introductory pages).

Technical Report entitled "Development of Large Drop Sprinklers (0.64–IN. Orifice Diameter)", Factory Mutual Research Corp., Jun. 1976 (38 pp. including cover and introductory pages).

SFTE Bulletin, 77–2, Apr. 1977, Boston, MA, (pp. 1,7 and 8).

"File Ex643 Project 80NK16583 Report on Automatic Sprinklers", Underwriters Laboratories, Inc., May, 1981 (18 pp.).

Technical Report entitled "Large–Drop Automatic Sprinklers", Factory Mutual Research Corp., Feb. 1982 (76 pp. with cover and introductory pages).

*Fire Protection Handbook Fifteenth Edition*, National Fire Protection Association, Sep. 1981, Title Sheet, Inner Sheet and pp. 17–32 through 17–40.

*Fire Protection Handbook Sixteenth Edition*, National Fire Protection Association, Mar. 1986 (Title Sheet, Inner Sheet, Table of Contents pg. xi and pp. 18–22 through 18–26, 18–36 through 18–59 and 18–77 through 18–82).

*Approved Product News*, Factory Mutual Engineering Corp., vol. 4, No. 2, Dec. 1988, pp. 1–5, 8–12 and 16.

*Fire Protection Handbook, Seventeenth Edition*, National Fire Protection Association, 1991, Title page, inner page, Table of Contents pg. ix and pp. 5–127 through 5–163 and 5–174 through 5–197.

*Sprinkler Tech Notes*, National Fire Sprinkler Association, Inc., vol. XVII, Nov. 5, Dec. 1994 (12 pp.).

"Automatic Sprinklers for Fire–Protection Service/UL 199/ Second Edition", Underwriters Laboratories, Inc., Feb. 1966, Cover, Table of Contents and pp. 22–27.

NFPA 13 Standard for the Installation of Sprinkler Systems 1991 Edition", National Fire Protection Association, Jul. 1991, Cover and pp. 13–1, 13–9, 13–11, 13–12, 13–31, 13–55 through 13–57 and 13–62.

NFPA 13 Standard for the Installation of Sprinkler Systems 1994 Edition", National Fire Protection Association, Jan. 1994, Cover and pp. 13–1, 13–7 through 13–10, 13–27, 13–52 through 13–54 and 13–59.

"1996 Annual Meeting Report on Proposals", National Fire Protection Association for Automatic Sprinklers, 1995 (cover and pp. 693, 694 and 701–720).

"FMRC Update", Factory Mutual Research Corp., vol. 8, No. 3 (2 pp.).

Central Sprinkler Corp. drawing for "Deflector, Upright/.64 Orifice Sprinkler", last amended Nov. 18, 1986, Drawing No. B–131–09 Rev. 6.

Sample Central Sprinkler Corp. D–64 Sprinkler with upright deflector of Drawing B–131–09 Rev. 6.
Underwriters Laboratories, Inc., UL 199, Standard for Automatic Sprinklers for Fire Protection Service, Eighth Edition, Feb. 1990.
National Fire Protection Association (NFPA) 13, Installation of Sprinkler Systems, Feb. 1989.
Underwriters Laboratories, Inc., UL 1626, Standard for Safety–Residential Sprinklers for Fire–Protection Service, First Edition, Apr. 1988.
Factory Mutual Research, Approval Standard for Automatic Sprinklers for Fire Protection Service, Dec. 1983.
"Product Profile–First U.L. Listed Extended Coverage Ordinary Hazard Sprinklers", Fire Protection Contractor, May 1992, (cover, pp. 46–50).
Factory Mutual Research, Approval Standard, Large Drop Sprinklers, Class No. 2007, Sep. 1979.
Factory Mutual, Loss Prevention Data, 2–7, "Installation Rules for Sprinkler Systems Using Large–Drop Sprinklers", Mar. 1990.
Underwriters Laboratories, Inc., UL 1767, Standard for Safety, Early–Suppression Fast–Response Sprinklers, First Edition, Feb. 1990.
Factory Mutual, Loss Prevention Data, 2–2, "Early Suppression Fast Response Sprinklers", Apr. 1987.
Factory Mutual, Approval Standard, Early Suppression Fast Response Automatic Sprinklers, Jun. 1986.
Viking, Technical Data, "Quick Response High Challenge Large Drop Sprinklers", Sprinkler, Jul. 26, 1989, pp. 115–116.
Data Sheet, ASCOA Fire Systems, "Automatic ESFR Glass Bulb Sprinkler", Mar. 1992, (pp. 1.1–1.2).
Grinnell Corporation, Data Sheet, "Early Suppression Fast Response Sprinklers, Model ESFR–1 Pendent, 14.3 K–FActor".
Reliable, Product Announcement, "ESFR, Model H, Early Suppression Fast Response Sprinkler", Oct. 1992.
Viking, Technical Data, "Aquamiser Model B Quick Response Specific Application Sprinkler", Sprinkler, May 31, 1991, pp. 117a, 117b, 117c.
Central Sprinkler Corporation, "The Omega'Commercial/Residential Quick Response Automatic Sprinkler, Model EC–20 Pendent", Aug. 1985.
NFPA, 1986 Fall Meeting, "Technical Committee Reports", pre–May, 1986, (cover, pp. 424–425).
NFPA, 1986 Fall Meeting, "Technical Committee Documentation", Nov. 1986, (cover, pp. 88–90, 11).
Reliable, "Model GXLO–ECOH, Model GFR XLO–ECOH, Extended Coverage Ordinary Hazard Sprinklers", Bulletin 128, (2 pp.).
Central Sprinkler Corporation, Test Results for Extended Coverage Ordinary Hazard.
Central Sprinkler Corporation, Videotape (VHS), "The Optima Sprinklers, Extended Coverage Ordinary Hazard Sprinkler Testing (ELO–16, ESLO–20)".
Advertisement for Aquamiser™; The Viking Corporation, 210 N. Industrial Park Road, Hastings, MI 49058. (undated)
Central Sprinkler catalog insert for Omega™ EC–20A (EC–20A 4–87); Central Sprinkler Corporation, 451 North Cannon Avenue, Lansdale, PA 19446. Apr. 1987.
Central Sprinkler Bulletin AS–D.64 Rev. No. 3 "Extra Large Orifice Automatic Sprinkler Model 'D.64' Upright"; Central Sprinkler Corporation. Aug. 1985.
"Adjustable Royal Flush Concealed Sprinkler Model '76A'", Bulletin RFS–76A Rev. No. 7, Sep. 1984, Central Sprinkler Corporation, Lansdale, PA, (2 pp.).

EXTENDED COVERAGE CEILING SPRINKLERS AND SYSTEMS

This is a continuation of application Ser. No. 07/875,928 filed Apr. 29, 1992, now U.S. Pat. No. 5,366,022, which is a continuation in part of U.S. patent application Ser. No. 07/769,917 filed Sep. 30, 1991, now abandoned, which is incorporated by reference herein.

BACKGROUND OF THE INVENTION

Heretofore, thinking in the fire protection art has been directed towards the use of multiple sprinklers for the protection of interior areas more than about one to two hundred square feet so as to limit the maximum average area protected by each sprinkler. As the perceived fire threat rises, the recommended protected area of coverage for each sprinkler is reduced. Such thinking has been embodied, for example, in accepted industry standards such as the Standard for the Installation of Sprinkler Systems, NFPA-13, issued by the National Fire Protection Association.

According to the National Fire Protection Association, NFPA-13 was first printed in 1896 under the direction of the Committee on Automatic Sprinklers and has been continuously revised since that time. NFPA-13 defines various requirements for sprinkler systems utilized in occupied interior spaces or "occupancies" with different fire hazard potentials. The NFPA-13 recognizes three general hazard categories for sprinkler systems: light, ordinary and extra. As defined by the NFPA-13, light hazard occupancies are those where the quantity and/or combustibility of contents is low and fires with relatively low rates of heat release are expected. Ordinary hazard covers those occupancies where the quantity and/or combustibility of the contents is equal to or greater than that of light hazard, ranging from low to high, where the quantities of combustibles is moderate and stock piles do not exceed twelve feet, such that fires with moderate to high rates of heat release are expected. Extra hazard occupancies are those where quantity and combustibility of the contents is very high and flammable or combustible liquids, dust, lint or other materials are present, such that the probability of rapidly developing fires with high rates of heat release is very high. The present invention is directed specifically to the protection of light and ordinary hazard occupancies, which define the bulk of most potential commercial installations.

NFPA-13 also specifies maximum areas of protection per sprinkler for the various hazards. For example, the normal maximum protection area limit per sprinkler for a sprinkler system in a light hazard occupancy is two hundred twenty-five square feet. The maximum protected area per sprinkler in an ordinary hazard occupancy is one hundred thirty square feet.

The protection area of a sprinkler is also defined by NFPA-13. The protection area of a sprinkler is at least rectangular and may be square, and equals "S"×"L". "S" is defined as the greater of the distance from the sprinkler in question to the farthest spaced, immediately adjoining sprinkler, upstream or downstream, on the same supply line, or twice the distance from the sprinkler in question to a wall where the sprinkler in question is the last sprinkler on a supply line extending in a direction towards the wall. "L" is the greater of the perpendicular distance to the farthest spaced branch line immediately adjoining either lateral side of the branch line supporting the sprinkler in question, or twice the perpendicular distance to the farthest spaced wall immediately adjoining either side of the branch line which supports the sprinkler in question and which lacks an immediately adjoining branch line between it and the wall. In the case of small rooms where the there is overlapping sprinkler coverage, the protection area of each sprinkler is considered to be the area of the room divided by the number of sprinklers.

NFPA-13 specifies maximum spacings of fifteen feet between lateral, side-by-side immediately adjoining branch lines and fifteen feet between immediately adjoining sprinklers along the same branch line, and up to one-half those spacings for an immediately adjoining wall, for light hazard occupancies, for a permitted maximum total protection area per sprinkler of two-hundred and twenty-five square feet. NFPA-13 further specifies a maximum spacing of up to fifteen feet between lateral, side-by-side immediately adjoining, branch lines or up to fifteen feet between immediately adjoining sprinklers on the same branch line and up to one-half those spacings in the case of an adjoining wall, for a permitted maximum total protection area per sprinkler of up to one-hundred and thirty square feet. In 1973, Section 4-1.1.1.3 was adopted and incorporated into the NFPA-13. That section stated:

> Special sprinklers may be installed with larger protection areas or distance between sprinklers than are specified in Sections 4-2 and 4-5 when installed in accordance with the approvals or listing of a testing laboratory.

At the time, Sections 4-2 and 4-5 defined the maximum spacings and protection areas indicated above.

In 1987 that section of the NFPA-13 was amended to read:

> Special Sprinklers-Installation of special sprinklers with protection areas, locations and distances between sprinklers differing from those specified . . . shall be permitted when found suitable for such use based on fire tests related to hazard category, tests to evaluate distribution, wetting of floors and walls, and interference to distribution by structural elements and tests to characterize response to sensitivity.

Underwriters Laboratories, Inc. ("UL") is the independent laboratory most widely utilized in the United States for testing and listing sprinklers. Its main sprinkler test standard for sprinklers conforming to NFPA-13 is UL 199 for Automatic Sprinklers For Fire-Protection Service. At the time the present invention was made, UL 199 set forth test requirements for automatic sprinklers varying in nominal orifice size from ¼ inch to 17/32 inch. The most widely sold and utilized ceiling sprinklers in the United States were and are nominally ½ inch in orifice size and are referred to as "standard orifice" sprinklers by UL, NFPA and the industry. Sprinklers of about 17/32 inch diameter were and are referred to as "large orifice" sprinklers.

Prior to the present invention, increased area coverage protection under NFPA-13 Section 4-1.1.1.3 had been offered only for light hazard occupancies by the modification of existing, standard orifice sprinklers. For example, in 1987, Central Sprinkler Corporation ("Central") introduced extended-coverage, with an adjustable pendent, standard orifice sprinkler, the EC-20, which was UL listed for light hazard occupancies with protection area coverages of up to four hundred square feet per sprinkler and up to 20 foot spacings between sprinklers and between branch lines with such sprinklers. After Central pioneered extended coverage in light hazard with a standard orifice ceiling sprinkler, others in the industry followed.

While Central demonstrated the possibility of providing extended coverage protection for light hazard with standard orifice sprinklers, several problems faced Central and anyone else seeking to provide ordinary hazard protection for extended coverage areas greater than the maximum one-hundred and thirty square feet protection areas specified in NFPA-13 for ordinary hazard listed sprinklers.

A first problem was that increasing the size of the protection area of a sprinkler requires exponentially greater quantities of water to be delivered by the sprinkler, necessitating higher operating pressures. For example, NFPA specifies and UL lists sprinklers for light hazard protection for various protection areas on the basis of a minimum average delivered density of 0.10 gallons per minute (GPM)/foot square ($ft^2$) into the protection area. Listings for ordinary hazard protection required deliveries in the range of from 0.16 to 0.21 GPM/$ft^2$ Recently this range has been reduced to one of 0.15 to 0.20 GPM/$ft^2$.

The discharge coefficient or "K factor" of a sprinkler determines the amount of water delivered through the sprinkler as a function of water pressure at the sprinkler. The discharge coefficient equals the flow of water in gallons per minute through the orifice of the sprinkler divided by the square root of the pressure of the water fed into the sprinkler in pounds per square inch. UL 199 defines a standard orifice sprinkler (½ inch diameter) as one having a discharge coefficient of 5.3 to 5.8±5 percent. It also defines the discharge coefficient of a large orifice sprinkler as ranging between 7.4 to 8.2±5 percent.

A standard orifice sprinkler requires a minimum pressure of about 16 psi in order to provide a minimum density of 0.10 GPM/$ft^2$ over a conventional two-hundred and twenty-five foot protection area (spacings of fifteen feet between sprinklers and fifteen feet between branch lines). Increasing the spacings by one-third to twenty feet nearly doubles the area of average coverage per sprinkler (up to four hundred square feet), but requires a minimum pressure of about 50 psi, more than three hundred percent greater than the minimum pressure required for fifteen-foot spacings.

To provide the minimum ordinary hazard densities of 0.15 GPM/$ft^2$ over the standard 130 square foot protection area with a standard orifice sprinkler requires a minimum pressure of about 12 psi. To extend the coverage to a 225 square foot area (15 foot maximum spacings) requires a minimum pressure of about 36 psi for such sprinklers. Increasing the spacings of standard orifice sprinklers to sixteen feet square, eighteen feet square and twenty feet square would require minimum sprinkler head pressures of nearly 50 psi, about 75 psi and over 100 psi, respectively. To provide 0.20 GPM/$ft^2$ to the same fifteen, eighteen and twenty foot square areas would require minimum pressures of about 65, 85, 135 and over 200 psi with standard orifice sprinklers.

It is believed that a minimum pressure requirement of about 35 psi per sprinkler would necessitate the provision of a booster pump in at least some of the potential ordinary hazard occupancies in the United States, that a minimum requirement of about 50 psi would necessitate a booster pump in a majority of such occupancies, that a minimum requirement of 60 psi, would necessitate a pump in eighty to ninety percent of such occupancies, and that a minimum requirement of about 75 psi would necessitate a pump in virtually all potential ordinary hazard occupancies. The cost of providing such a pump typically ranges upwards from about $35,000. Thus, many, if not most, potential ordinary hazard occupancies would require a booster pump to support extended coverage, standard orifice sprinkler systems.

A second problem was that no one knew if the quantities of water needed to be delivered could be successfully delivered with an acceptable level of uniformity over such extended areas or specifically how to do so. Merely increasing pressure to a conventional, light or ordinary hazard sprinkler or even to a conventional extended coverage light hazard sprinkler, does not predictably provide extended coverage distribution or deliver higher densities of water to a protected area. Virtually all existing ordinary hazard sprinklers have deflectors which severely limit their water discharge pattern and thus the protection area of the sprinkler. Increasing pressure will simply cause the sprinkler to deliver more water over the same limited area. As was just discussed, the delivery of water densities required for the upper end of ordinary hazard protection through an existing, standard orifice, extended coverage sprinkler over an area of sixteen or more feet square necessitates a booster pump in many if not most occupancies.

Even where pressure is boosted, adequate water distribution is not assured. At high pressures, distributed water may mist before reaching the protection area, and thus not be delivered. Another possibility is that the distribution pattern may collapse as the sprinkler deflector is effectively overwhelmed by the water column and a more restricted distribution pattern actually developed at higher pressures.

A third problem was that neither UL nor any other recognized testing laboratory had an established procedure or set of standards to test sprinklers or sprinkler systems for extended coverage listings in ordinary hazard occupancies. Although the possibility of providing such sprinklers had existed since at least 1973 under NFPA-13, no one ever tested or even proposed to test such a sprinkler.

Sprinkler engineers typically design sprinklers to satisfy recognized performance tests and standards, such as those of UL. Lacking recognized and established tests or performance standards, ordinary sprinkler engineers had no clear understanding of what to design to provide extended coverage, ordinary hazard protection.

As a practical matter, a sprinkler without a UL listing or a listing or approval by another of the recognized, major independent testing laboratories or associations in the United States would have little, if any, commercial value due to the requirements of various state and local governments and various fire insurers.

SUMMARY OF THE INVENTION

In one aspect, the invention is a ceiling sprinkler comprising: a generally tubular body having an outlet orifice at one end, the tubular body having a K factor greater than 8.7, where the K factor equals the flow of water in gallons per minute through the tubular body divided by the square root of the pressure of the water fed into the tubular body in pounds per square inch; a plug at least generally closing the orifice; a triggering element releasably retaining the plug closing the orifice; a deflector having a major surface facing, the orifice; and a support coupling the deflector and the sprinkler body with the major surface spaced from and generally aligned with the orifice so as to be impacted by a flow of water issuing in a column from the orifice after release of the plug. The deflector and support are configured and positioned to deflect the water flow generally radially outwardly all around the column and when pressurized to distribute water at some average discharge density of 0.10 GPM/$ft^2$ or more over a contiguous planar area of two hundred fifty-six square feet or more, and actually deliver water at a density in gallons per minute of at least ten percent of the magnitude of the average discharge density, on average, per square foot, in each two-foot square portion of the area when the deflector is positioned at some location between the contiguous area and a planar ceiling parallel to the area at a spacing no greater than seven and one-half feet above the contiguous area and no more than two feet below the ceiling.

In another aspect, the invention is a ceiling sprinkler comprising: a generally tubular body having an outlet orifice at one end, the tubular body having a K factor greater than 8.7, where the K factor equals the flow of water in gallons per minute through the tubular body divided by the square root of the pressure of the water fed into the tubular body in pounds per square inch; a plug at least generally closing the orifice; a triggering element releasably retaining the plug closing the orifice; a deflector having a major surface facing the orifice; and a support coupling the deflector and the sprinkler body with the major surface spaced from and generally aligned with the orifice so as to be impacted by a flow of water issuing in a column from the orifice after release of the plug. The deflector and support are configured and positioned to deflect the water flow generally radially outwardly all around the column such that when the ceiling sprinkler is arranged with three other sprinklers identical to the ceiling sprinkler to define an at least rectangular array having an area of at least 144 sq. ft., with a separate one of the sprinklers located at each of the four corners of the rectangle, the deflectors being positioned at or within two feet of a generally smooth ceiling parallel to and at least coextensive in area with the sprinkler defined rectangle, and water is supplied to each of the four identical sprinklers at a pressure so as to flow through each sprinkler at a discharge rate equal to the area of the sprinkler rectangle in square feet times a selected discharge density of at least 0.15 GPM/ft$^2$, water is projected by the four identical sprinklers at least onto a square area centered with respect to the sprinklers no more than three feet beneath the sprinkler deflectors, the centered square being at least six feet shorter on a side than a shorter side of the sprinkler rectangle, and the centered square area receives water from the four sprinklers at an average density in GPM/ft$^2$ at least equal to the selected discharge density in GPM/ft$^2$ and each square foot of the centered square area receives at least 0.02 GPM.

In another aspect, the invention is a ceiling sprinkler comprising: a generally tubular body having an outlet at one end, the tubular body having a K factor greater than 8.7, where K equals the flow of water in gallons per minute through the tubular body divided by the square root of the pressure of the water fed into the tubular body in pounds per square inch; a plug at least generally closing the orifice; a triggering element releasably retaining the plug closing the orifice; a deflector having a major surface facing the orifice; and a support coupling the deflector and the sprinkler body with the major surface spaced from and generally aligned with the orifice so as to be impacted by a flow of water issuing in a column from the orifice upon release of the plug. The major surface is substantially planar with a generally circular outer perimeter, has a plurality of slots angularly spaced around a center of the major surface, each of the slots extending through the deflector and at least generally radially inwardly from the perimeter to no closer than one-half inch from the center of the major surface. The major surface has an outer diametric dimension of at least 1.7 inches and a central annular flat area facing the outlet with an outer diametric dimension greater than 0.8 inches.

In yet another aspect, the invention is a ceiling sprinkler system installed within a structure proximal a ceiling and over a contiguous area to be protected by the system, the area being located below the ceiling and at or above a floor immediately below the ceiling within the structure. The system comprises: a first water supply conduit located proximal the ceiling within the structure and over the area; and a first plurality of sprinklers, each sprinkler of the first plurality including a generally tubular sprinkler body coupled with the first conduit and an outlet orifice, a plug releasably retained at least generally closing the outlet orifice, a deflector having a major surface facing the orifice and a support coupling the deflector with the tubular body. The one major surface of each deflector is spaced from and aligned with the orifice for receiving a flow of water issuing from the orifice in a column after release of the plug. Each tubular body has a K factor greater than 8.7, where the K factor equals the flow of water in gallons per minute through the tubular body divided by the square root of the pressure of the water fed into the tubular body in pounds per square inch. The one major surface of each deflector of the first plurality of sprinklers is located at or below a lower side of the ceiling facing the area during operation of the sprinkler. The sprinkler is configured so as to disperse the water column generally radially outwardly all about the sprinkler and onto the area below the sprinkler when activated. At least one pair of the sprinklers of the first plurality immediately adjoin one another on the first conduit and are spaced at least sixteen feet apart on the first conduit with no vertical wall between them.

In yet another aspect, the invention is a ceiling sprinkler system installed within a structure, proximal a ceiling and over a contiguous area within the structure to be protected by the system, the area being located below the ceiling and at or above a floor immediately below the ceiling. The system comprises: a first water supply conduit located within the structure proximal the ceiling and over the area; and a first plurality of sprinklers, each sprinkler of the first plurality including a generally tubular sprinkler body coupled with the first conduit and an outlet orifice, a plug releasably retained at least generally closing the outlet orifice, a deflector having a major surface facing the orifice and a support coupling the deflector with the tubular body. The one major surface of each deflector is spaced from and aligned with the orifice for receiving a flow of water issuing from the orifice in a column after release of the plug. Each tubular body has a K factor greater than 8.7, where the K factor equals the flow of water in gallons per minute through the tubular body divided by the square root of the pressure of the water fed into the tubular body in pounds per square inch. The one major surface of each deflector is located at or below a lower side of the ceiling facing the area. The sprinkler is configured so as to disperse water generally radially outwardly all about the sprinkler and onto the area below the sprinkler when the plug is released. The first conduit is spaced more than fifteen feet from a second conduit of the system immediately adjoining one lateral side of the first conduit, the second conduit being generally parallel to the first conduit, proximal the ceiling and located over the area, or more than seven and one-half feet from the closest immediately adjoining wall on a lateral side of the first conduit where no other sprinkler supporting conduit of the system adjoins the first conduit.

In yet another aspect, the invention is a ceiling sprinkler system installed within a structure, proximal a ceiling and over a contiguous area within the structure to be protected by the system the area being located below the ceiling and at or above a floor immediately below the ceiling within the structure. The system comprises: a first water supply conduit located within the structure proximal the ceiling and over the area; and a plurality of sprinklers, each sprinkler of the first plurality including a generally tubular sprinkler body coupled with the first conduit and having an outlet orifice, a plug releasably retained at least generally closing the outlet orifice, a deflector having one major surface facing the orifice and a support coupling the deflector with the tubular body, the one major surface being spaced from and aligned with the orifice for receiving a flow of water issuing from the orifice in a column after release of the plug. The tubular body of at least one of the sprinklers has a K factor of more than 8.7, where the K factor equals the flow of water in gallons per minute through the tubular body divided by the square root of the pressure of the water fed into the tubular body in pounds per square inch. The one major surface of the one deflector is located at or below a lower side of the ceiling facing the area and is configured so as to disperse water generally radially outwardly all about the one sprinkler and onto a portion of the open area below the one sprinkler when activated. The one sprinkler protects a portion of the open area equalling S times L, where S is the greater of the distance from the one sprinkler to the farthest located sprinkler on the first conduit immediately adjoining the one sprinkler, or twice the distance from the one sprinkler to an immediately adjoining wall of the structure where no other sprinkler is supported from the first conduit between the sprinkler and the wall, and where L equals the greater of the perpendicular distance from the first conduit to the farthest located conduit of the system supporting a plurality of sprinklers proximal the ceiling and over the area, which farthest located conduit is generally parallel with and immediately adjoins a lateral side of the first conduit, or twice the perpendicular distance from the first conduit to an immediately adjoining wall on a lateral side of the first conduit lacking another immediately adjoining, parallel conduit of the system, and where S times L is at least 144 square feet.

BRIEF DESCRIPTION OF THE DRAWINGS

The foregoing summary, as well as the following detailed description of preferred embodiments, will be better understood when read in conjunction with the appended drawings. For the purpose of illustrating the invention, there is shown diagrammatically in the drawings embodiments which are presently preferred. It should be understood, however, that the invention is not limited to the specific embodiments, instrumentalities, elements and methods disclosed. In the drawings.

DETAILED DESCRIPTION OF PREFERRED EMBODIMENTS

Figure 1:
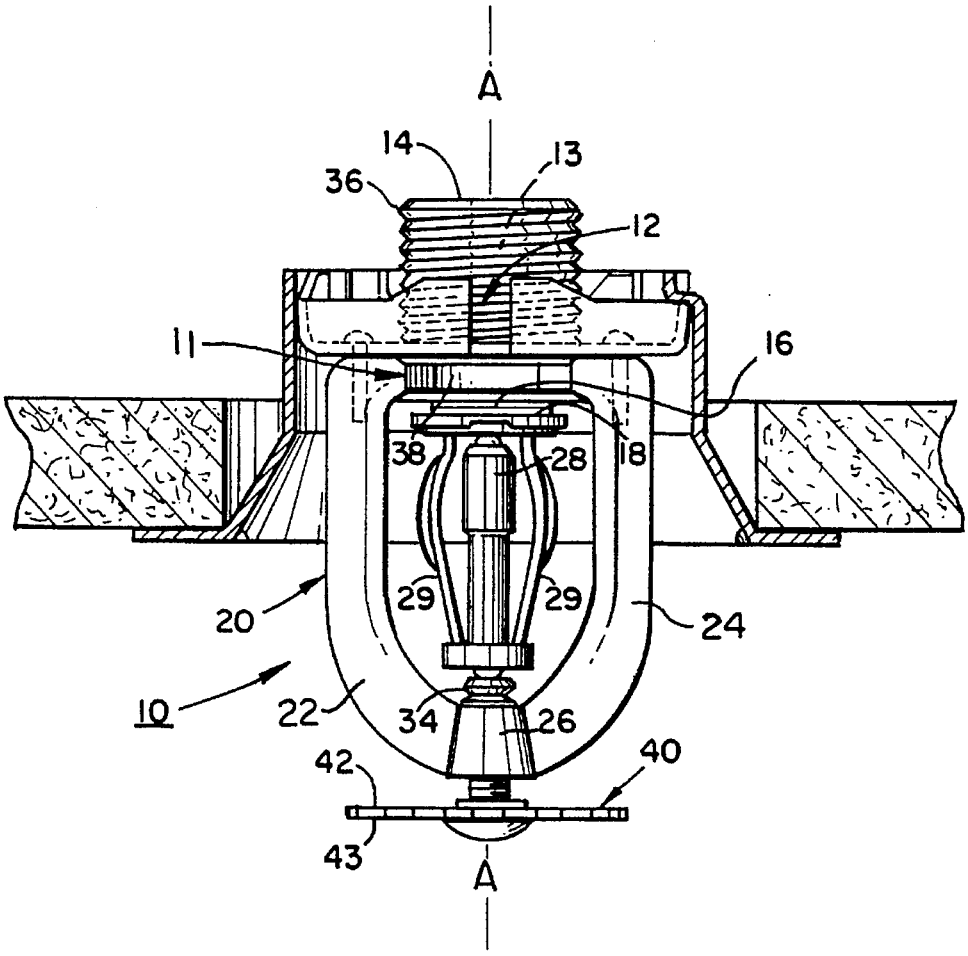
FIG. 1 is a side elevation view of a preferred embodiment pendent ceiling sprinkler in accordance with the present invention.

Certain terminology is used in the following description for convenience only and is not limiting. The words "right", "left", "lower" and "upper" designate directions in the drawings to which reference is made. The words "radially" and "axially" refer to directions perpendicular to and along a central axis of an object, element or structure referred to while the words "inwardly" and "outwardly" refer to directions towards and away from, respectively, the geometric center of the device, or structure. The terminology includes the words above specifically mentioned, derivatives thereof and words of similar import. Moreover, throughout the drawings, like numerals are used to indicate like elements.

Referring to FIG. 1 there is shown a preferred embodiment, frame-type ceiling sprinkler in a pendent configuration indicated generally at 10. Sprinkler 10 includes a one piece frame 11 provided by a generally tubular body 12 and an adjoining yoke 20.

Body 12 defines a passageway 13 having one open end defining an inlet 14 and an opposing open end defining an outlet orifice 16. The sprinkler body 12 may be conventionally provided with threading 36 to enable the inlet end of the sprinkler body to be screwed into a supply pipe or stem extended from a conduit supplying several sprinklers and at least a pair of opposing parallel planar flange side surfaces, one of which is indicated at 38, to apply a wrench to the sprinkler body 12 to secure it to the supply pipe.

The yoke 20 is preferably integrally and monolithically formed with the tubular body 12 and comprises two mirror-image arms 22 and 24 which extend away from the tubular body 12 longitudinally with respect to a central or discharge axis A—A of the outlet orifice. Preferably, arms 22 and 24 merge at a junction or knuckle 26 centered on the discharge axis A—A. A plug 18 is located in the orifice 16 closing the orifice 16, at least essentially, blocking the passageway 13 through the tubular body 12. In a wet sprinkler, plug 18 has no opening therethrough so as to permit the sprinkler 10 to be pressured with water for actuation. In a dry sprinkler, plug 18 is typically provided with a tiny opening to permit drainage of any residual water or condensation from the sprinkler. A releasable element, indicated diagrammatically at 28, is positioned between the plug 18 and junction 26 to retain the plug 18 in the orifice 16. Element 28 is preferably a thermally responsive, frangible device but may be an alcohol-filled glass bulb or any other suitable, thermally frangible or releasable element or suitable, electrically released element. Such release mechanisms and elements are well known to those of ordinary skill in this art. The preferred frangible device includes a fusible alloy which is sealed into a bronze center strut by a stainless steel ball. When the alloy melts at its rated temperature, the ball is forced upward into the center strut releasing two ejectors 29, freeing the plug 18. A thermal bulb element 28 retains plug 18 until it is heated sufficiently to expand the alcohol, bursting the glass and releasing the plug 18 from the orifice 16. The indicated thermally responsive element 28 is exemplary only, and may, for example, have one end received in a depression in the center of the plug 18 and an opposing end received in a depression in the tip of an adjustment screw 34 which is threadingly received in the bore passing through the junction 26.

Preferably, a deflector 40 of the present invention is supported from the frame 11 by being integrally mounted to one end of the adjustment screw 34 so as to be fixedly held by the adjustment screw 34 to the yoke 20 coupled with the sprinkler body 12 or is fixedly coupled directly to the junction 20. Each preferred deflector 40 has two circular opposing major surfaces 42 and 43. One major surface 42 is spaced from and generally aligned with the orifice 16, preferably centered with respect to the discharge axis A—A, facing the orifice, so as to be impacted by a flow of water, indicated by arrow F in FIGS. 3 and 4, which issues or passes from the outlet orifice 16 with activation of the sprinkler 10.

The sprinkler 10 differs from other prior art, frame-type ceiling sprinklers in the configuration of its deflector 40 and, in some respects, in the size of its orifice. One aspect of the present invention is the use of sprinkler bodies with "extra large" and "super large" orifice sizes with higher K factors. In particular, sprinkler bodies of the present invention have K factors greater than those of standard and even large orifice sprinklers previously used for extended coverage. Large orifice sprinklers have K factors of 7.4 to 8.2±5 percent (or a maximum K factor of 8.7). Preferably "extra large" orifices of about 0.64 inches and "super large" orifices of about 0.70 inches in diameter are used to provide K factors greater than 8.7 and typically about eleven and fourteen, respectively. Sprinklers with such extra and super large orifices are capable of supplying relatively larger volumes of water while minimizing the minimum water pressures which must be provided to produce such flows. The benefits which rise from this relation will be discussed in greater detail later in this description.

The preferred body 12 of the extra large orifice sprinkler 12 has a nominal height of about one and one-quarter inch with an internal passageway having an inlet diameter of about 0.77 inches and tapering conically downward at an included cone angle of about eight degrees to eight and one-half degrees to a diameter of about 0.63 inches near the outlet end, where the diameter is maintained for at least about 0.1 inch. The last 0.65 inches of the passageway is configured to meet the requirements for releasing the plug. The passageway may be cylindrical at the same diameter or may flare outwardly, for example.

The preferred body of the super large orifice sprinkler 12 has a nominal height of about one inch, with an internal passageway having an inlet diameter of about 0.76 inches tapering conically downward to an included angle of about five degrees to a diameter of about 0.70 inches, which is maintained for about one-eighth inch. The outlet end of the sprinkler beyond this orifice is again configured suitably to receive and release a plug.

Figure 2:
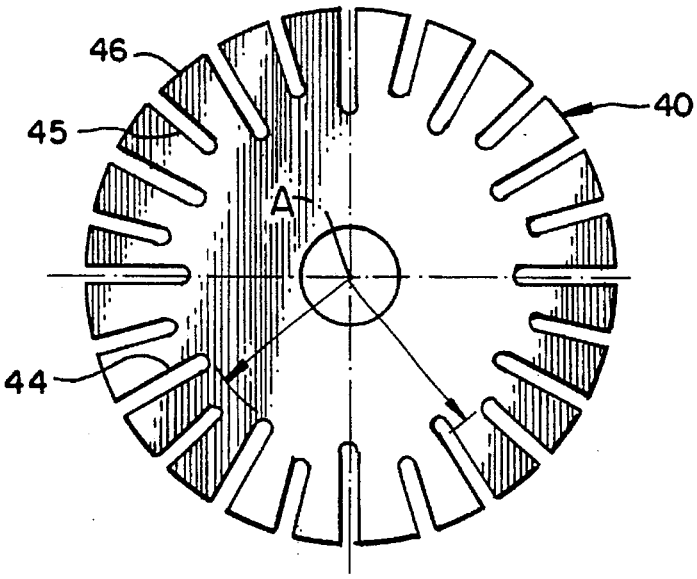
FIG. 2 is a bottom plan view of a preferred, embodiment deflector of the invention.

FIG. 2 depicts the lower major surface 43 of the deflector 40 which, as preferred, is identical to the upper surface 42 facing the orifice 16. Spacing between the proximal end of the tubular body 12 and the inner major side 42 of the deflector is preferably about one and one-third inches or more. Sprinkler deflectors 40 the present invention have nominal outer diameters greater than the width of the water column issuing from the orifice 16 and, more particularly, preferably between about 1.7 and about 2.3 inches or more for the exemplary tubular body to deflector spacing of about 1.6 inches used in the subsequent examples. Suggestedly, at least sixteen and, preferably, about twenty-four uniformly angularly spaced slots are provided. Longer slots, indicated at 44, are preferably alternated with shorter slots indicated at 45. Each of the slots 44, 45 extends generally radially inwardly from a curvilinear, preferably circular, outer perimeter 46 of the deflector 40 and axially entirely through the deflector 40. The widths of the slots suggestedly range between about 0.03 and 0.095 inches and preferably are between about 0.04 and about 0.06 inches. Suggestedly, the slots extend radially inwardly about one-fifth of an inch or more with the longer slots 44 extending inwardly no closer than about 0.5 inches to the center of the deflector 40, which lies along discharge axis A—A, and preferably no closer than about 0.6 inches to the center. Suggestedly, the surfaces 42, 43 have solid planar central annular areas which are at least one inch and, preferably, about 1.2 inches or more in diameter for the exemplary tubular body to deflector spacing of about 1.6 inches used in the subsequent examples. Preferably, too, the total open area provided by the slots 44, 45 is at least about ten percent and no more than about thirty percent of the total surface area of either side 42, 43 of the deflector within the outer perimeter.

Figure 3:
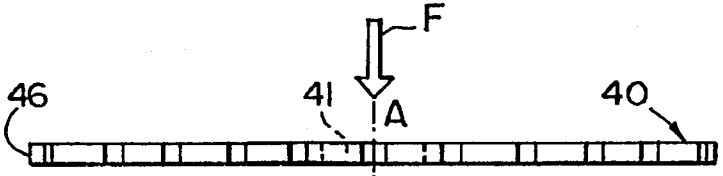
FIG. 3 is a side elevation of a pendent/recessed pendent configuration of the deflector of FIG. 2.

One presently preferred pendent/recessed pendent sprinkler 10 is the previously described tubular body 12 having a nominal orifice diameter of about 0.64 inches providing a nominal K factor of about 11, in combination with a 1.86 inch outer diameter circular deflector, essentially flat as shown in FIG. 3, having twenty-four slots each nominally 0.062 inches in width and extending radially inwardly from the circular edge 46 of the deflector alternately about 0.275 and 0.35 inches, respectively. Spacing between the outlet orifice and facing surface 42 of the deflector is nominally about 1.6 inches. This deflector provides protection for ordinary hazard occupancies delivering minimum water densities of from 0.15 to 0.21 GPM/ft$^2$ and with minimum spacings of thirteen feet and maximum spacing of up to sixteen feet between adjoining pairs of sprinklers and up to eight feet from any sprinkler to any adjacent wall, for a maximum protection area of 256 ft$^2$ per sprinkler. This protection is provided for placement of the sprinkler deflectors at heights from seven and one-half feet down to only three feet above an open contiguous area being protected. This open area is conventionally defined to be the top layer of commodities or structures within the occupancy beneath the sprinkler(s) and within the confines of the walls of the structure.

Another presently preferred configuration of a pendent/recessed pendent ceiling sprinkler 10 utilizes a sprinkler body 12 having a nominal orifice diameter of 0.70 inches, which provides a nominal K factor of more than 14, with a presently preferred circular deflector 40 having about an outer diameter of about 2.3 inches and which is also essentially flat, as shown in FIG. 3. Twenty-four uniformly angularly spaced, alternately longer and shorter slots are provided, each about 0.062 inches wide. Longer slots 44 extend approximately 0.57 inches inwardly from the circular edge 46 while the shorter slots extend radially inwardly about 0.5 inches. This sprinkler configuration provides protection for all ordinary hazard occupancies providing minimum water densities of at least 0.15 and up to 0.21 GPM/ft$^2$, respectively, with minimum sprinkler-to-sprinkler and branch line-to-branch line spacings of thirteen feet and maximum spacings of up to twenty feet for a maximum protection area of 400 sq. ft. per sprinkler, at least when the sprinklers are no more than seven and one-half and as close as three feet to the protection area, which, again, is considered the top layer of commodities or structures opposite the sprinkler(s) which are protected by the sprinklers.

These two pendent/recessed pendent sprinkler configurations together provide a range of continuous coverages of from thirteen-by-thirteen to twenty-by-twenty feet, all within minimum sprinkler design pressures of no more than about 35 psi per sprinkler for the highest ordinary hazard density of 0.21 GPM/ft$^2$.

Figure 4:
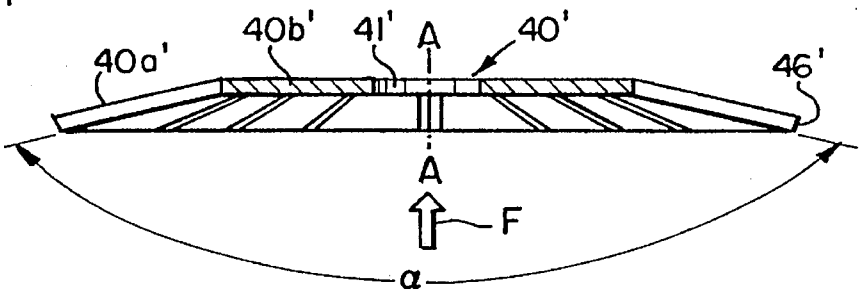
FIG. 4 is a side elevation of an upright configuration of the deflector of FIG. 2.

The invention is preferably applied to upright ceiling sprinklers by coning an outermost annular portion **40*a* of the deflector 40 at an included cone angle alpha of about one-hundred-forty degrees or more, preferably about one-hundred-fifty degrees to about one hundred seventy degrees, while providing a central, essentially flat annular portion 40*b* which is surrounded by the frustoconical outermost annular portion 40*a* and is oriented perpendicularly to the discharge axis A—A, as shown in FIG. 4**. The central annular area is suggestedly at least about one inch in outer diameter and preferably about 1.2 inches in outer diameter, for the disclosed tubular body to deflector spacings and constructions. Overall diameters of the deflectors are suggestedly about two inches or more and, preferably, between about 2 and 2.3 inches for the disclosed spacings and constructions. Preferably, the slots extend radially inwardly from the outer perimeter of each deflector along much to most of the length of the fructoconical portion. Again the slots extend axially entirely through the deflector. In other respects these deflectors are the same as the pendent ceiling sprinkler deflectors, including the provision of variable length slots.

A first, presently preferred configuration of an upright ceiling sprinkler utilizes a sprinkler frame 11 having a body 12 with a nominal orifice diameter of about 0.64 inches providing a nominal K factor of about 11, in combination with a substantially flat yet slightly frustoconical deflector 40' having a two-inch outer diameter and an essentially flat, central annular portion **40*b'* surrounded by an outer, coned annular portion 40*a'*, as shown diagrammatically in FIG. 4. The deflector 40' again has twenty-four uniformly spaced slots each nominally 0.046 inches in width and extending radially inwardly from the circular edge 46 of the deflector alternately about 0.345 and 0.42 inches, respectively, towards the central axis A. The flat, central annular portion 40*B'* is approximately 1.2 inches in diameter, while the outer annular portion 40*a'* is coned at an included cone angle alpha of about one hundred fifty-two degrees (approximately a fourteen-degree deflection from the central annular portion). This deflector 40'** provides distribution for ordinary hazard occupancies of minimum water densities from 0.15 to 0.21 GPM/ft$^2$, and with minimum spacings of thirteen feet between adjoining sprinklers and branch lines to maximum spacings of sixteen feet between adjoining sprinklers and branch lines (and a maximum spacing of eight feet from adjoining walls), to provide a maximum protection area of 256 square feet with a minimum spacing from the deflectors to the protection area of from seven and one-half down to as close as three feet.

A second, presently preferred upright sprinkler configuration utilizes a sprinkler frame 11 having a body 12 with a nominal orifice diameter of 0.70 inches providing a nominal K factor of more than 14 together with another presently preferred circular deflector 40' having an outer diameter of about 2.3 inches, which is substantially flat and slightly frustoconical as shown in FIG. 4. Twenty-four uniformly angularly spaced, alternately longer and shorter slots are provided, each about 0.062 inches in width. The longer slots 44 (see FIG. 2) extend approximately 0.57 inches radially inwardly from the circular outer edge 46', while the shorter slots extend radially inwardly about 0.5 inches. The flat, central annular portion **40*b'* of the deflector 40' has an outer diameter of about 1.2 inches and the outer conical portion 40*a'*** defines an included cone angle of about one hundred seventy degrees (five-degree deflection from flat, central annular portion). The sprinkler provides protection for ordinary hazard occupancies with minimum water densities of from 0.15 to 0.21 GPM/ft$^2$ and with minimum spacings of fifteen feet between sprinklers and branch lines and maximum spacings of up to twenty feet between sprinklers and branch lines (ten feet from an adjoining wall) and for a range of heights from seven and one-half feet down to at least three feet above a protection area, for a maximum protection area of at least four hundred square feet.

When combined with the previous, upright sprinkler configuration, these two upright sprinklers together can provide continuous coverage from minimum sprinkler and branch line spacings of thirteen feet up to maximum sprinkler and branch line spacings of twenty feet for all ordinary hazard occupancies with a minimum design pressure of only about 35 psi per sprinkler.

Figure 5:
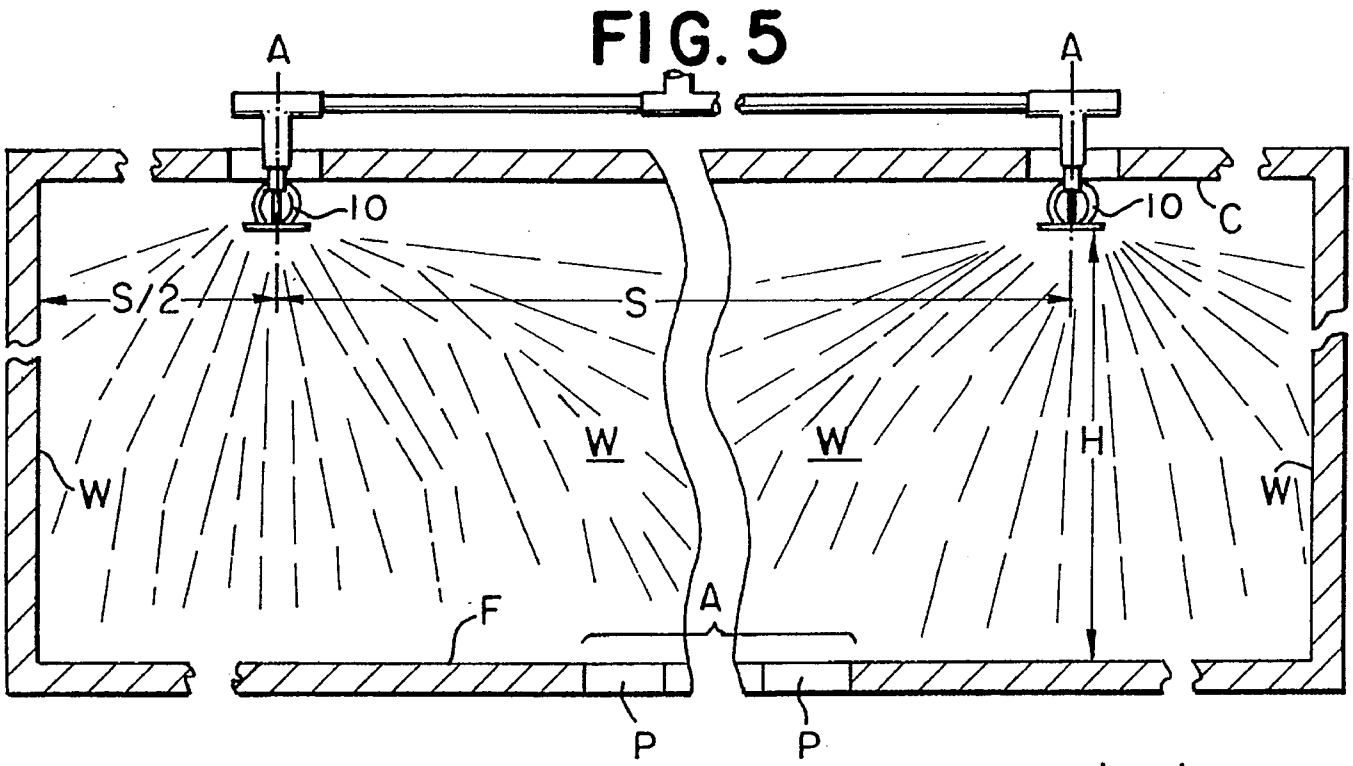
FIG. 5 depicts in side elevations the layout of a ceiling sprinkler system employing the preferred embodiment pendent ceiling sprinkler of the present invention.
Figure 6:
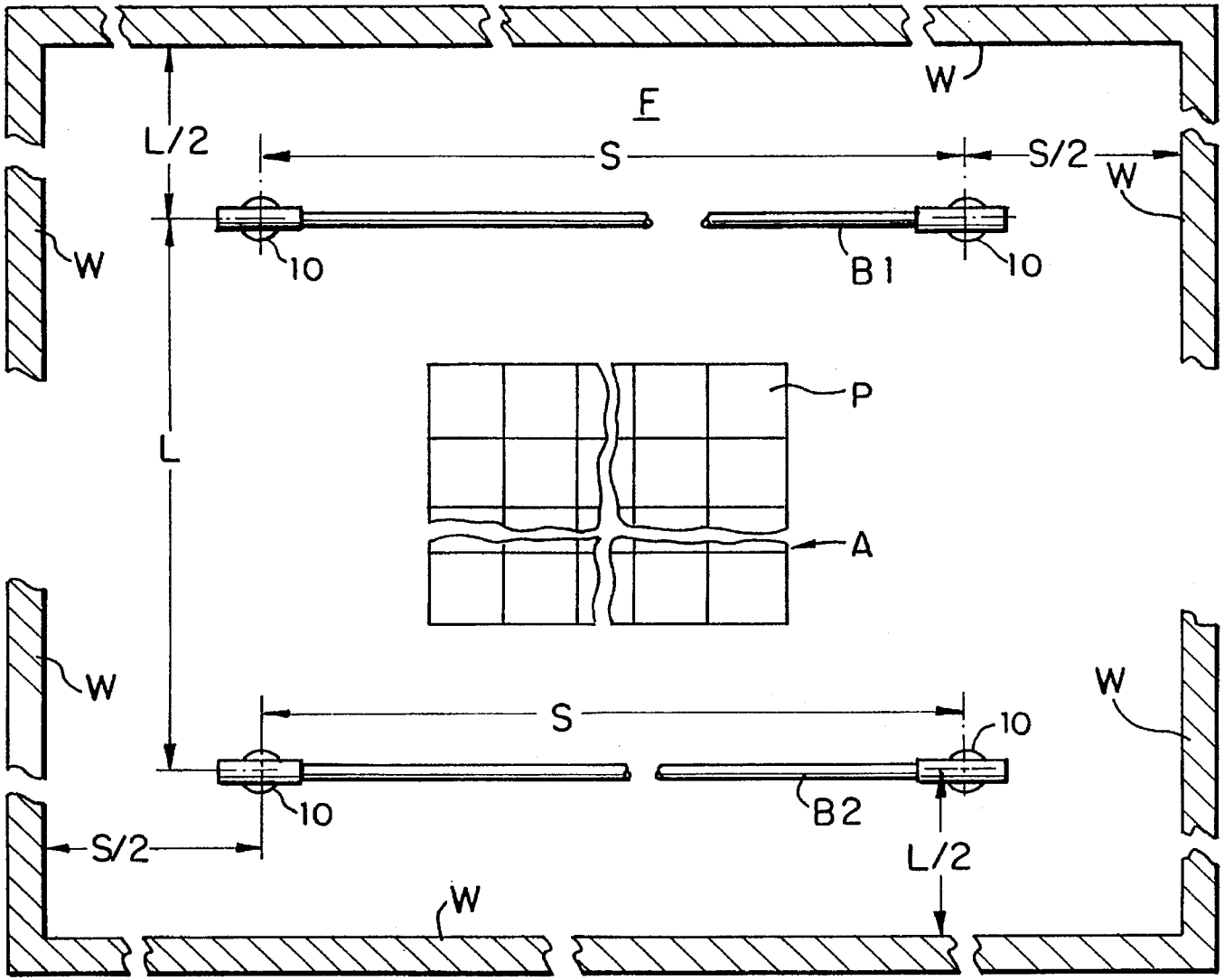
FIG. 6 depicts the system of FIG. 5 in partially broken plan view.

FIG. 5 depicts diagrammatically a ceiling sprinkler system utilizing the preferred embodiment, frame-type, recessed pendent ceiling sprinklers 10 of the present invention. Recessed pendent sprinklers extend at least to and, in the case of the preferred embodiments 10 through a ceiling C so as to protect an opposing contiguous area F within a structure. The perimeter of the total area F protected by the system in an actual occupancy is defined by vertical walls W extending generally from between the ceiling and floor immediately below the ceiling within the structure and at least generally surrounding the area F within the structure. The operating height for UL rated sprinklers, or at least UL commercially rated sprinklers, is based upon spacing of the sprinkler deflector from the highest underlying structures or contents in the area being protected, rather than just a height above a floor. Area F is used in this figure to represent the area below the ceiling sprinklers 10 which is effectively protected and is generally located above the floor which is immediately below the ceiling. Permitted spacing of deflectors for upright, pendent or recessed pendent ceiling sprinklers from the lower deck or side of the ceiling C is at least one inch and no more than about two feet under any ceiling construction in ordinary hazard occupancies. Each of the specific sprinkler configurations disclosed herein permits a horizontal spacing "S" between nearest adjoining pairs of sprinklers 10 of the system on the same branch line B1 or B2, together with a perpendicular distance spacing "L" between immediately adjoining lateral side-by-side branch lines B1, B2 (see FIG. 6), which are more than fifteen feet, preferably at least sixteen feet. Sprinklers 10, including those of the present invention, normally should be spaced no more than one-half their rated maximum spacing S or L from an adjoining wall or walls W.

Water distribution for extended coverage sprinklers of the present invention is tested by installing four identical sprinklers so as to define a rectangle representing the dimensions of the protection area of the sprinkler, each of the sprinklers being located at each of the four corners of the rectangle. The arrangement includes two sprinklers each on two parallel lines B1 and B2. While extended coverage ceiling sprinklers to date have been substantially symmetrically rated or listed for identical maximum sprinkler-to-sprinkler and branch line-to-branch line spacing, it is not inconceivable that sprinklers with elliptical distribution patterns providing more asymmetric, rectangular distributions could be developed and installed for this purpose. The sprinklers are preferably installed with their deflectors lying in a common plane located about seven inches below the lower deck or surface of a ceiling C, which is parallel to and at least coextensive with the rectangle defined by the four sprinklers. When operated, water is projected by the four identical sprinklers onto a square area A centered beneath and parallel to the sprinkler rectangle. Each side of the centered area A has a length which is at least six feet shorter than the shorter side of the sprinkler rectangle. Maximum perpendicular spacing H from the deflectors of the four sprinklers to the plane of the square area A is seven and one-half feet, while the minimum spacing is as close as the sprinklers will permit and still satisfy the requirement for distribution, preferably at least as close as three feet between the plane of the deflectors of the sprinklers and the centered area A. Water is passed to each of the four sprinklers at a rate in GPM equal to the minimum distribution density required for the hazardous occupancy sought to be protected times the area of the rectangle defined by the sprinklers. The minimum distribution densities for the various hazards are: 0.10 GPM/ft$^2$ for light hazard and 0.15–0.20 GPM/ft$^2$ (previously 0.16–0.21 GPM/ft$^2$) for ordinary hazard. Water is collected for a sufficiently long period of time to give measurable amounts, for example ten minutes, in foot square pans P, the open mouths of which define the centered square area A.

When located at a height H of seven and one-half feet above the protection area pans P, sprinklers of the present invention deliver water into the centered square area A at an average rate in GPM at least equal to the area of the centered square area A times the selected discharge density in GPM/ft$^2$ or more. Moreover, at least fifty percent or more of the selected discharge density is delivered to each foot square pan within the entire centered square area A and at least two-thirds or more of the discharge density is delivered, on average, per foot, into each four-foot square portion of the centered square area A. So, for example, at a 0.15 GPM/ft$^2$ discharge density, at least 0.15 GPM is actually delivered per square foot, on average, over the entire area A, a density of at least 0.075 GPM is actually delivered to each foot square pan, and a density of at least 0.10 GPM is delivered, on average, per square foot, in each four-foot square portion of the centered area.

At a spacing of only three feet between the plane of the deflectors of the described preferred embodiment sprinklers and the centered square area A, the four sprinklers again actually deliver to the entire centered square area A, on average, per square foot, a density equal to the selected discharge density. The sprinklers further actually deliver water at a density of at least 0.03 GPM into each foot square portion of the centered square area A, and at a density, on average, per square foot, of at least one-half the selected discharge density into each four-foot square portion of the centered square area.

This invention offers, for the first time, an economical means and method of achieving extended coverage fire protection for ordinary hazard occupancies which can reduce the net cost of providing such extended coverage protection. The costs of manufacturing sprinklers of the present invention are typical to the costs of manufacturing standard orifice sprinklers. However, extended coverage will, in most installations, require fewer sprinklers and branch lines, and obviate the need to provide pressure-boosting pumps. The avoidance of the use of booster pumps entirely is itself a significant economic advantage of the present invention. However, the majority of the installed cost of a sprinkler system lies not in the cost of the components, but in a manpower cost of installation. Sprinklers and sprinkler systems of the present invention offer the potential of significant reductions in such costs, since, in many if not most cases, fewer sprinklers and fewer branch lines are needed to provide protection in any given area.

The benefits of the present invention further carry over in the use of these sprinklers in light hazard occupancies where the extremely low minimum design pressure of about 13 psi required per sprinkler for 400 sq. ft. coverage (twenty-by-twenty) for an extra large orifice (K factor of about 11) sprinkler permits the use of such sprinklers in longer than normal runs, again without the need to augment or boost supply pressures.

While several specific configurations of preferred embodiments of the invention have been disclosed and modifications thereto suggested, it will be recognized by those skilled in the art that other changes may be made to the invention without departing from the broad inventive concepts thereof.

For example, while a frame-type sprinklers are disclosed, one of ordinary skill in the art will appreciate that the teachings of the present invention can be incorporated into drop-down type ceiling sprinklers of the various types described, for example, in U.S. Pat. Nos. 4,014,388, 4,491,182, 4,508,175, 4,618,001, 4,630,688, 4,976,320, 5,083,616, and 5,094,198, each assigned to the assignee of this application and incorporated by reference herein.

One of ordinary skill will further appreciate that having demonstrated the ability to distribute water with adequate densities over such extended areas with the disclosed deflectors, that it would be possible to distribute water with other deflector configurations. Most simply, the relative dimensions of the disclosed deflectors can be varied simply by varying the spacing of the deflector from the proximal sprinkler body end. However, it is believed that all subsequent versions of this invention will adopt a generally horizontal spray pattern of large droplets which characterize the distribution patterns of the preferred deflectors and sprinklers of the present invention.

It is further suggested that thermally responsive elements used in the sprinkler be selected to provide the quickest response times possible to activate the sprinklers as quickly as possible after the beginning of a fire. It is suggested that the temperature responsive element have a response time index ("RTI") of less than one hundred and preferably less than fifty. It is believed that such a response time index can be achieved in several ways, for example, by variations in the wall thicknesses of glass bulb release elements of the type previously noted.

It should be understood, therefore, that this invention is not limited to the particular embodiments or instrumentalities shown, but is intended to cover all modifications which are within the scope and spirit of the invention as defined by the appended claims.

We claim:

1. An improvement to a ceiling sprinkler for use in fire control, said sprinkler having a generally tubular body having an outlet orifice at one end, a plug at least generally closing the orifice, a triggering element releasably retaining the plug, wherein the improvement comprises the tubular body having a K factor greater than 9 and further comprising deflector means generally shaped and arranged for achieving a generally horizontal spray pattern of water droplets such that said ceiling sprinkler may be spaced apart from any other sprinkler identical to said ceiling sprinkler at least 16 feet or more whereby said ceiling sprinkler covers a rectangular area of 256 or more square feet and is effective in controlling ordinary hazard fires.

2. The sprinkler of claim 1 wherein said ceiling sprinkler may be spaced apart from any other identical sprinkler up to at least 18 feet or more to each cover an area of 324 or more square feet and remains effective in controlling ordinary hazard fires.

3. The sprinkler of claim 2 wherein said ceiling sprinkler may be spaced apart from any other identical sprinkler up to at least 20 feet or more to each cover an area of up to 400 square feet and remains effective in controlling ordinary hazard fires.

4. The sprinkler as in any of the claims 1, 2 and 3 wherein the tubular body has a K factor of between about 11 and 14.

5. The sprinkler of claim 4 wherein the tubular body has a K factor of about 14.

6. The sprinkler of claim 1 being effective in controlling ordinary hazard fire in said area located at a height of three feet below said sprinkler.

7. The sprinkler of claim 1 wherein the deflector means has a circular outer perimeter and a plurality of slots extending axially entirely through the deflector means and radially inwardly from the outer perimeter to a central area surrounded by the slots, the central area lacking any openings permitting water to pass through the deflector means in the central area.

8. The sprinkler of claim 6 wherein the deflector means has a circular outer perimeter and a plurality of slots extending axially entirely through the deflector means and radially inwardly from the outer perimeter to a central area surrounded by the slots, the central area lacking any openings permitting water to pass through the deflector means in the central area.

9. The sprinkler as in any of the claims 6, 7 and 8 wherein the tubular body has a K factor of between about eleven and fourteen.

10. The sprinkler of claim 9 wherein the tubular body has a K factor of about fourteen.

11. In a system of ceiling sprinklers for effective control of ordinary hazard fires wherein each sprinkler has a generally tubular body and an outlet orifice at one end, a plug generally closing the outlet orifice and a triggering element releasably retaining the plug, and the outlet orifice having a K factor greater than 9, the improvement comprising spacing sprinklers from each other such that each sprinkler is spaced 16 feet or more from the closest adjoining sprinklers so that each sprinkler covers an area of 256 or more square feet, and providing each sprinkler with a deflector means opposite and facing the outlet orifice for achieving a generally horizontal spray pattern of water droplets.

12. The system of claim 11 wherein each sprinkler is spaced 18 feet or more from the closest adjoining sprinklers so that each sprinkler covers an area up to 324 or more square feet.

13. The system of claim 12 wherein each sprinkler is spaced 20 feet or more from the closest adjoining sprinklers so that each sprinkler covers an area up to 400 or more square feet.

14. The system as in any of the claims 11, 12 and 13 wherein the tubular body of each sprinkler has a K factor of between about 11 and 14.

15. The system of claim 14 wherein the tubular body of each sprinkler has a K factor of about 14.

16. The system of claim 11 wherein the deflector means of the ceiling sprinklers are configured such that when four identical ceiling sprinklers of the system are identically arranged in a plane to define a rectangle having an area of at least 256 sq. ft., with a separate one of the four ceiling sprinklers being located at each of the four corners of the rectangle, and the deflector means are positioned at or within two feet of a generally smooth ceiling parallel to and at least coextensive in area with the sprinkler defined rectangle, and water is supplied simultaneously to each of the four ceiling sprinklers at a pressure sufficient to flow through each sprinkler at a discharge rate equal to the area of the sprinkler defined rectangle in square feet times a selected discharge density of between 0.15 GPM/ft$^2$ and 0.20 GPM/ft$^2$, both discharge densities being inclusive, the water is actually delivered by the four ceiling sprinklers such that a square area centered with respect to the four ceiling sprinklers and located no more than three feet beneath the sprinkler deflector means, the centered square area being at least six feet shorter on a side than a shortest side of the sprinkler defined rectangle, receives water from the four ceiling sprinklers at an average density in GPM/ft$^2$ at least equal to the selected discharge density in GPM/ft$^2$ and each square foot of the centered square area receives at least 0.02 GPM.

17. The system of claim 16 wherein the sprinkler defined rectangle has an area of at least 324 square feet.

18. The system of claim 16 wherein the four sprinklers actually deliver water at an average density in GPM/ft$^2$, which is at least forty percent of the selected discharge density, to each four-foot square portion of the centered square area, when the four sprinklers are supplied with water at the selected density.

19. The system of claim 16 in which the four ceiling sprinklers deliver water at a density of at least 0.03 GPM to each square foot of the centered square area, when the four sprinklers are supplied with water at the selected discharge density.

20. The system of claim 16 wherein the centered square area is located three feet below the sprinkler defined rectangle.

21. The system of claim 19 wherein the sprinkler defined rectangle has an area of at least 400 square feet.

22. The system as in any of the claims 16–19 wherein the tubular body of each sprinkler has a K factor of between about 11 and 14.

23. The system of claims 13–19 wherein the tubular body of each sprinkler has a K factor of about 14 or more.

24. The system of claim 11 wherein the area covered by each said sprinkler is located three feet beneath said sprinkler.

* * * * *